United States Patent [19]

Lowrance

[11] Patent Number: 5,018,117

[45] Date of Patent: May 21, 1991

[54] COMBINED RACING KITE GATE AND QUICK DRAW DEVICE

[76] Inventor: Arlen J. Lowrance, 7655 East 41st St., Tulsa, Okla. 74145

[21] Appl. No.: 603,443

[22] Filed: Oct. 26, 1990

[51] Int. Cl.[5] ..... G04B 47/00; A63H 27/08

[52] U.S. Cl. ..... 368/10; 244/155 R

[58] Field of Search ..... 368/3, 10, 107–109; 244/153 R, 155 A

[56] References Cited

U.S. PATENT DOCUMENTS

| | | |
|---|---|---|
| 3,277,706 | 10/1962 | Godet . |
| 3,338,536 | 8/1967 | Hull et al. . |
| 3,390,519 | 7/1968 | Cooper . |
| 3,398,957 | 8/1968 | King . |
| 3,430,581 | 3/1969 | Truesbell et al. . |
| 3,558,132 | 1/1971 | Melvin . |
| 3,712,615 | 1/1973 | Staats et al. . |
| 3,722,124 | 3/1973 | Nathanson et al. . |
| 4,454,757 | 6/1984 | Weinstein et al. . |
| 4,614,345 | 9/1986 | Doughty . |
| 4,864,854 | 9/1989 | van Leemput . |

*Primary Examiner*—Vit W. Miska

*Attorney, Agent, or Firm*—William S. Dorman

[57] ABSTRACT

A combined racing gate for kites and quick draw device comprising a vertical pipe, a vertical wand pivotally attached adjacent its lower end to the upper end of the vertical pipe, a weight slidably mounted within the pipe, a cord connected from the lower end of the wand to the weight for maintaining the wand in a normally vertical condition, an electrical switch mounted on the pipe, an electrical timer connected to the electrical switch, a cam mounted on the wand for actuating the electrical switch when the wand pivots to start and stop the timer, a horizontal pipe connected to the upper end of the vertical pipe, a target plate attached to the wand, a plurality of individual targets connected at right angles to the horizontal pipe, each individual target comprising a tube connected to the horizontal pipe, a vertical rod extending upwardly from the outer end of each tube, a target plate mounted at the upper end of each vertical rod in parallel relation to the target plate on the wand, a spring connected to the lower end of each vertical rod for holding the same in substantially vertical position, a horizontal rod attached to the end of each vertical rod and moveable therewith and a string connected from the outer end of each horizontal rod to the lower end of the wand.

7 Claims, 9 Drawing Sheets

Fig. 6
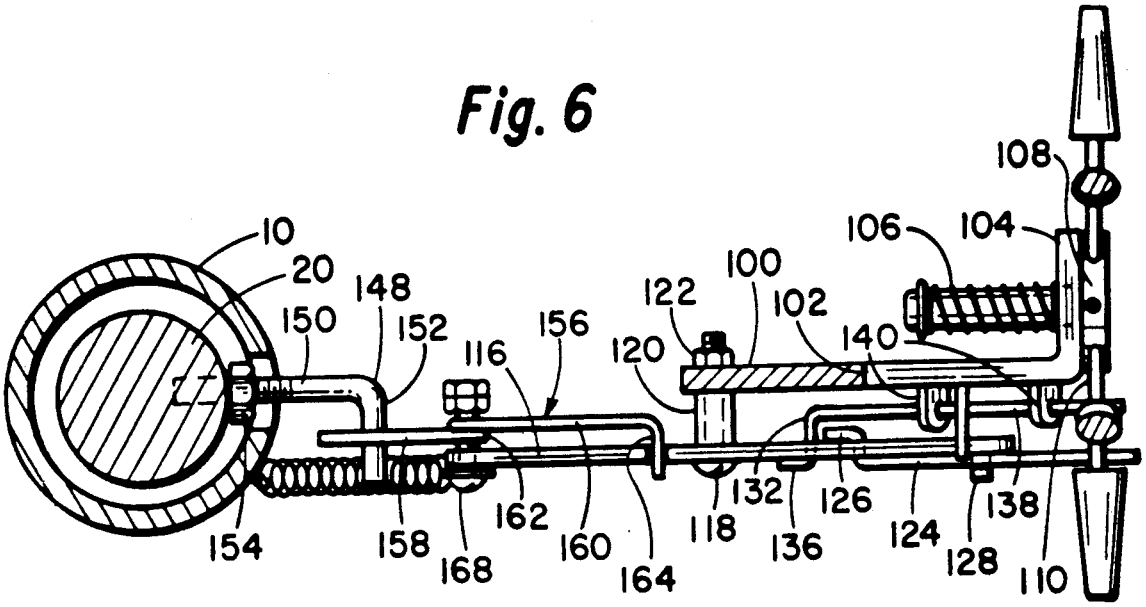
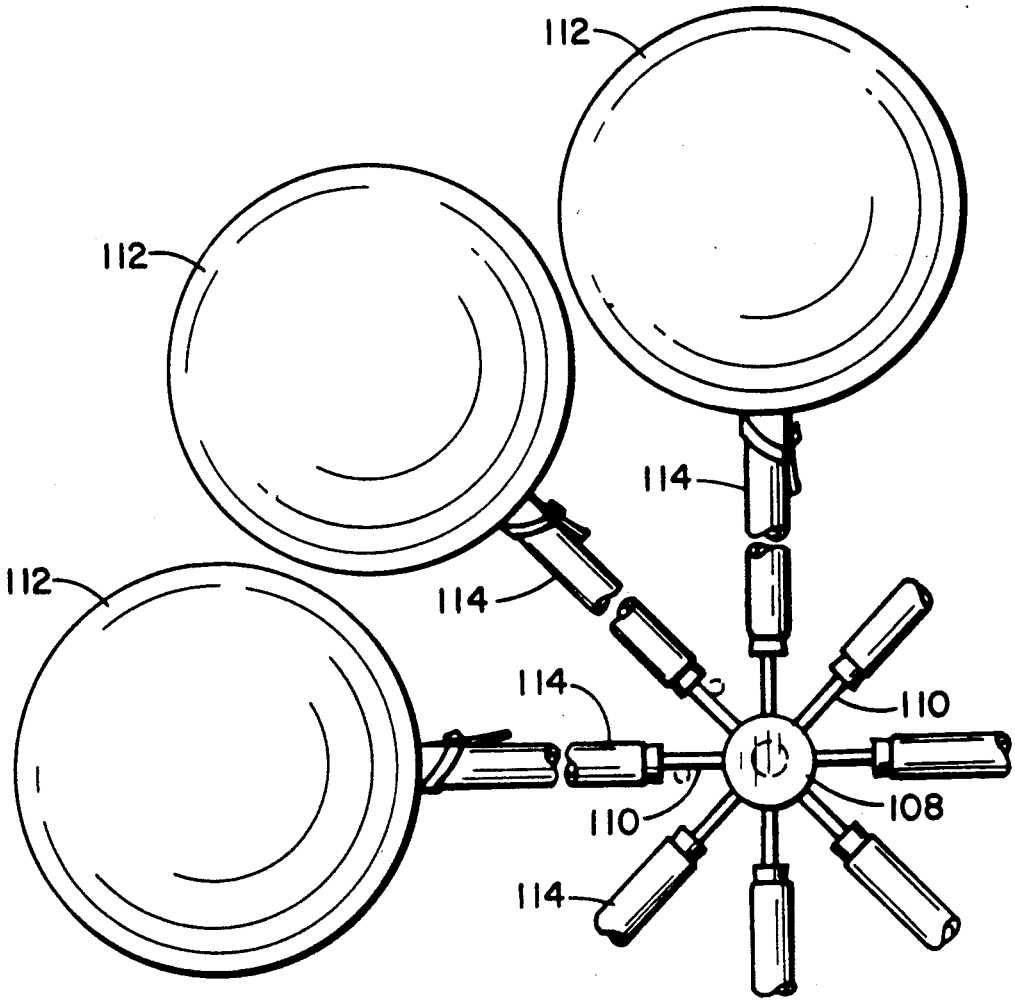
Fig. 7

COMBINED RACING KITE GATE AND QUICK DRAW DEVICE

CROSS REFERENCE TO OTHER APPLICATIONS

The present invention is an improvement over the invention disclosed in a co-pending application, Ser. No. 07/402,653, entitled "Racing Gate for Kites".

BACKGROUND OF THE INVENTION

1. Field of the Invention

The present invention relates to a device which can be employed as a racing gate or pylon. More particularly, the present invention relates to a racing gate or pylon which is actuated by the kite string or kite strings of a horizontally moving kite. The present invention also includes an adapter which can be added to the main vertical post of the racing gate to convert the same into a quick draw device.

2. The Prior Art

The sport of racing kites is becoming increasingly popular. There is one form of kite, sometimes referred to as a delta-wing kite, which is mounted on the end of a pair of kite lines, as opposed to a single kite line for the more conventional type of kite. When the delta kite is in the air, the two lines will extend downwardly to the ground where they are held, separately, in the hands of the operator. Without discussing the theory under which these double line kites operate, a skilled operator, by controlling the lines individually, can make these kites perform feats which are not normally possible with a conventional single line kite. It is possible, for example, with these delta-wing kites, after they have been launched in the air, to move these kites in a horizontal direction, at a great rate of speed where the kite is moving, as it were, on a knife edge, such that the tips of the kite wings form a line which is perpendicular to the ground.

In racing these delta-wing kites horizontally, it has become a practice of late to run these kites competitively through different horizontal and vertical patterns and to record the time required for each kite to traverse a given course. Thus, it can be said that there is a sport of kite racing.

At the present time the method of "timing" a kite over a predetermined course is by a stopwatch and visual observation (estimation) as to when the kite begins and finishes the course.

As far as the present inventor is aware, there are no gates which can be deflected by the movement of the kite which would permit an accurate timing of the movement of the kite over a given course along which such gates might be located.

The present invention also provides, in addition to the timing of the kite racing, devices which will visually indicate actuation of the gate by the kite string both for the initial actuation and for intermediate actuations of the gate up to, and including, the final actuation.

Finally, the present invention includes an adapter to be attached to the main post of the racing gate which will permit the use of the overall device as a quick draw system similar to a shooting gallery. As far as the present inventor is concerned, there are no devices or systems similar to the present quick draw shooting gallery.

Preliminary searches were conducted on the invention disclosed herein, and the following listed patents were uncovered in the searches:

| U.S. Pat. No. | Inventor | Issue Date |
|---|---|---|
| 380,899 | Jones | April 10, 1888 |
| 812,400 | Bremer | February 13, 1906 |
| 1,210,512 | Maurer | January 2, 1917 |
| 1,581,068 | Knopf | April 13, 1926 |
| 1,824,811 | Gade | September 29, 1931 |
| 2,095,413 | Harrison | October 12, 1937 |
| 2,491,176 | Hammond | December 13, 1949 |
| 2,561,733 | Foyst | July 24, 1951 |
| 2,894,751 | Simjian | July 14, 1959 |
| 2,905,469 | Taylor | September 22, 1959 |
| 2,957,693 | Ross | October 25, 1960 |
| 2,967,712 | Breitenfeldt | January 10, 1961 |
| 3,005,634 | Goette | October 24, 1961 |
| 3,008,712 | Konopka | November 14, 1961 |
| 3,054,614 | Dean | September 13, 1962 |
| 3,057,622 | Giannone | October 9, 1962 |
| 3,097,848 | Massa | July 16, 1963 |
| 3,277,706 | Godet | October 11, 1966 |
| 3,338,536 | Hull et al | August 29, 1967 |
| 3,390,519 | Cooper | July 1, 1968 |
| 3,398,957 | King | August 27, 1968 |
| 3,430,581 | Truesdell et al | March 4, 1969 |
| 3,558,132 | Melvin | January 26, 1971 |
| 3,712,615 | Staats et al | January 23, 1973 |
| 3,722,124 | Nathanson et al | March 27, 1973 |
| 4,454,757 | Weinstein et al | June 19, 1984 |
| 4,614,345 | Doughty | September 30, 1986 |
| 4,864,854 | vanLeemput | September 12, 1989 |

SUMMARY OF THE INVENTION

A racing gate for a kite comprising an essentially vertical pipe having means at the lower end to support the pipe from the ground, preferably by impaling, so that the gate can be movable from one location to another. An elongated wand is pivotally mounted adjacent to the upper end of the pipe and has an upper end which is adapted to project into the path of a moving kite, or more accurately into the path of the moving strings of a kite. The lower end of the wand below the pivot point is attached to a weight which is mounted within the pipe and is adapted to be raised and lowered as the lower end of the wand pivots so that when the wand is pivoted by the horizontal movement of a kite string against the upper end of the wand, the wand will return to its upright position after the kite string passes by. An electrically operated timer, such as a stopwatch, is connected to the pipe. The electrical lead for the timer passes through the pipe and is electrically connected to a microswitch mounted on the pipe. A cam is mounted on the wand in a position to actuate the microswitch when the wand is pivoted in a given rotary direction.

The racing gate also includes means for visually indicating the actuation of the wand by the kite strings. In one form this visually discernable device consists of a plurality of cups which are wind actuated and which are allowed to rotate by an escape mechanism which is responsive to the movement of the wand by the actuation thereof from the kite string. Another visual means for indicating movement of the wand is a plurality of balloons arranged in an essentially vertical plane and rotatable on a horizontal axis by indexing means responsive to the pivoting of the wand.

Finally, the present invention includes an adapter which can be attached to the main pipe of the racing gate and which will permit the use of the overall device as a quick draw system which is similar to that one might find in a shooting gallery. However, the actuation of the targets is quite different from what is found in any conventional shooting gallery.

BRIEF DESCRIPTION OF THE DRAWINGS

FIG. 6 is a sectional view taken along section lines 6—6 of FIG. 5;

FIG. 7 is a front elevation of a portion of the rotating balloon assembly by itself;

DETAILED DESCRIPTION OF THE PREFERRED EMBODIMENTS

Figure 1:
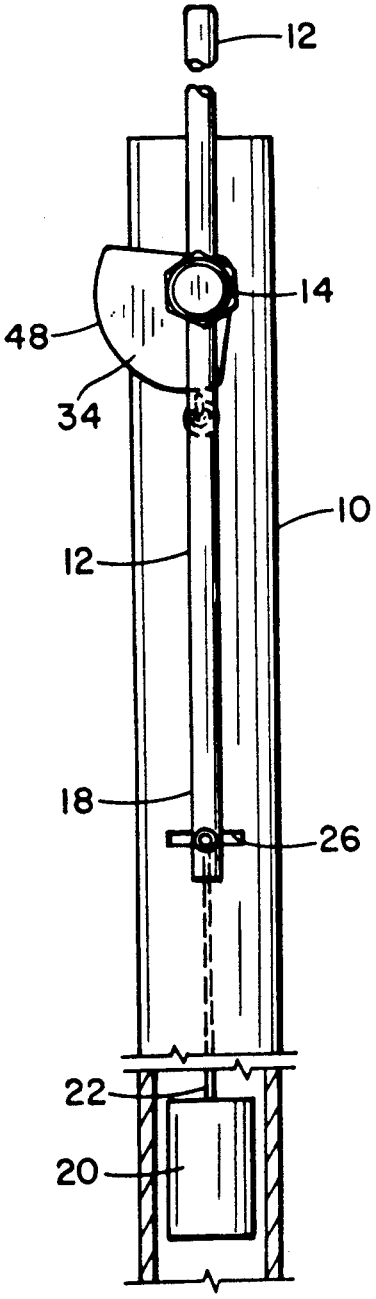
FIG. 1 is a rear elevation of a portion of the kite racing gate made in accordance with the present invention.
Figure 2:
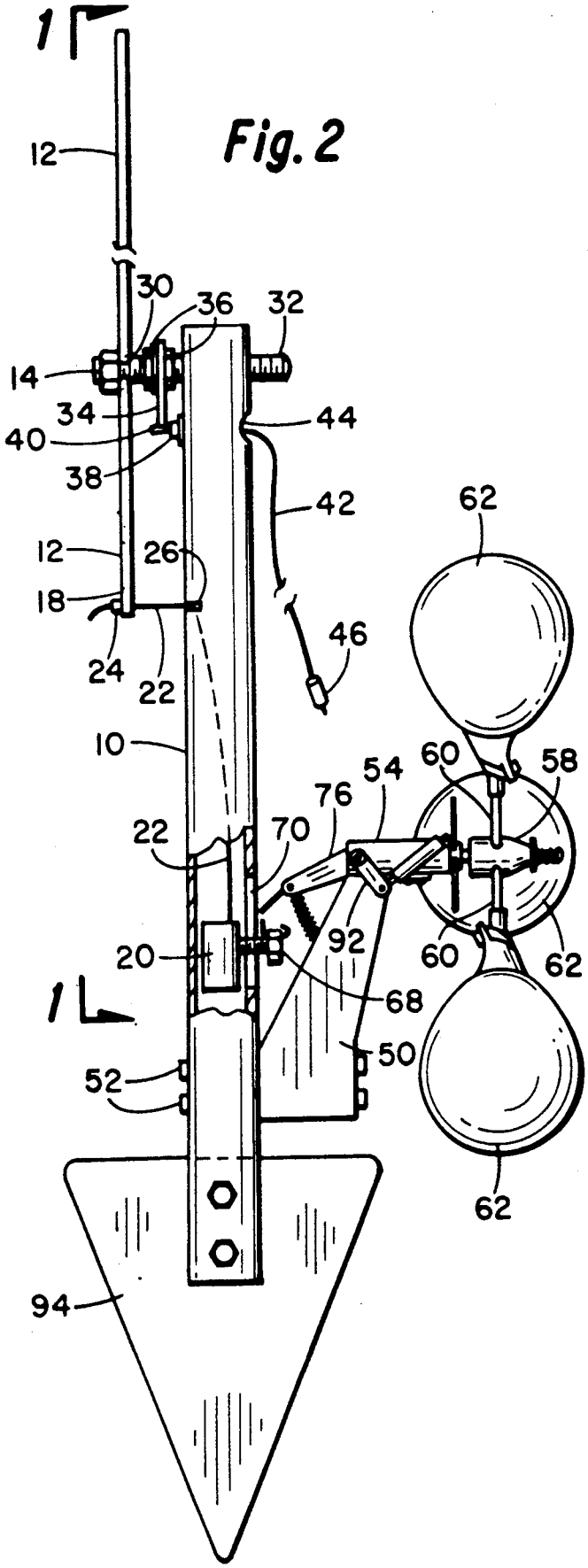
FIG. 2 is a left side elevation of the kite racing gate of the present invention.

Referring now to FIGS. 1 and 2, a kite racing gate is shown as comprising a vertical standard or support which consists of a tube or pipe 10 which can be made of metal (or preferably platic). A vertical wand 12 is pivotally connected to the pipe 10 adjacent the upper end of the latter by means of a bolt 14. The wand 12 is a hollow tube of plastic (preferably) or metal which can be provided with telescoping extensions (not shown) connecting with the upper end of the wand so that the effective vertical height of the wand 12 can be varied as desired. The lower end 18 of the wand connects with a weight 20 through a cord or cable 22. The upper end of the cable 22 passes through a hole (not referenced) in the lower end 18 of the wand and is provided with a knot or bead 24 which secures the end of the cord 22 to the lower end of the wand. The cord passes through a horizontal slot 26 in the pipe 10 and then downwardly to the weight 20, as shown. The weight 20 hangs freely at the end of the cord 22 within the pipe 10. If the wand 12 should pivot around the bolt 14, the lower end 18 of the wand would move, in a clockwise or counterclockwise direction, away from the slot 26 such that the weight 20 would be pulled upwardly. When the force (which was used to pivot the wand 12) is removed from the wand, the weight 20 will drop downwardly and move the wand back to the vertical position shown in FIG. 1.

The wand 12 passes through a vertical hole 30 in the bolt 14 such that the bolt will turn as the wand 12 pivots. The shank 32 of the bolt is threaded and is received in threaded holes (not shown) in the upper end of the pipe 10. An arcuate cam 34 is received on the bolt 14 between the wand 12 and the pipe 10. The cam 34 is held in position on the bolt 14 by means of a pair of lock nuts 36 disposed on opposite sides of the cam 34. Thus, when the bolt 14 rotates by virtue of the pivoting action of the wand 12, the cam 34 will also rotate. A microswitch 38 having an actuating arm or toggle 40 is mounted on the pipe 10 below the cam 34 such that the arm 40 is positioned in the path movement of the cam. Any convenient type of microswitch can be employed. However, the particular microswitch shown in FIGS. 1 and 2 is one wherein the microswitch 38 is actuated when the arm 40 is pushed downwardly; but, when the force is released from the arm 40, the latter will return automatically to its "up" position and the microswitch will be deactuated. The arm 40 would normally be described as a "momentary" arm. The microswitch 38 connects with an electrical cord 42 which passes out through an opening 44 in the pipe 10. The remote end of the cord 42 is provided with a connector or adapter 46 which will connect into a suitable electrical circuit (not shown) for running a stop-watch (not shown).

As indicated above, movement of the wand 12 could be caused by a string (strings) of a kite (not shown) moving in a horizontal direction wherein the string (strings) contacts the upper end of the wand 12. Assuming that the kite is moving in a right-to-left direction in relation to FIG. 1, when the string of the kite contacts the wand 12, the latter will pivot in a counterclockwise direction together with the bolt 14. The cam 34 will also turn in a counterclockwise direction. The outer edge 48 of the cam 34 is in the form of an arc or curve which is eccentric with respect to the center line of the bolt 14 (the rotational axis of the cam). Looking at FIG. 1, the vertical distance from the center of the shaft 14 to the edge 48 of the cam 34 is the minimum radius of the arc (edge) 48. That is, in the position shown in FIG. 1, the portion of the cam 34 which is proximate to the arm 40 of the microswitch 38 will not touch the arm 40. From the lower most portion of the edge (arc) 48 in FIG. 1, the radius (or the distance from the center of the shaft 14) will gradually increase. At a position approximately 30 degrees clockwise along the cam 34, from the lower right-hand end thereof, the radius of the edge (arc) 48 will be sufficient to contact and depress the arm 40 to actuate the microswitch 38. Therefore, if the wand, as shown in FIG. 1, were rotated 30 degrees counterclockwise from the position shown in this Figure the edge of the microswitch 34 would actuate the microswitch 38 to send a signal to the timer (not shown) through the wire 42 and the connector 46. Of course, the 30 degree movement could be varied by changing the shape of the edge 48 or by rotating the cam 34 relative to the bolt 14. That is, the lock nuts 36 could be loosened, the cam rotated in either direction and then the lock nuts 36 retightened.

Bearing in mind that it might be desirable to deflect the wand 12 more than twice during a "race", the timer should be started when the wand is deflected the first time and stopped when the wand is deflected for the last time. It is important that any intermediate (required) contacts with the wand 12 not affect the timer. As shown in FIG. 1 and assuming that the "race" has just begun, the operator of the kite will first cause the wand to be deflected by moving his kite in a right-to-left direction so as to turn the wand 12 in a counterclockwise direction and start the timer. If the rules of the race require the operator of the kite to contact the wand 12 between the first and the last contacts thereof, he must operate his kite so it approaches the wand from a left-to-right direction to pivot the wand in a clockwise direction.

It is recognized that there will be a certain amount of backlash every time the wand 12 is pivoted regardless of the direction of movement. That is when the wand 12 is moved in a clockwise direction by the action of the kite string, the weight 20 will tend to return the wand 12 to the vertical position shown in FIG. 1 after the kite string is passed beyond the wand. However the weight 20 will move the wand 12 quickly to the vertical position and there will be a tendency for the arm to continue moving by inertia past the vertical position of repose. This means that the arm will tend to move in a counterclockwise direction past the vertical position even though the weight 20 will be urging it in the opposite direction. Therefore, on the return of the wand 12 from a clockwise movement thereof, a portion of the cam 34 will move over the arm 40 of the microswitch 38 commensurate with the degree of backlash. On the other hand, since the cam 34 will not actuate the microswitch until it has moved 30 degrees in a counterclockwise direction, any backlash which provides less than 30 degrees counterclockwise movement of the arm 12 will not affect the operation of the timer.

The last contact with the wand 12 (for a given "race") must be in a right-to-left direction so that the wand 12 again turns in a counterclockwise direction. After the wand moves 30 degrees the cam 34 will actuate the arm 40 of the microswitch 38 to send a second signal to the timer to stop the same.

Figure 4:
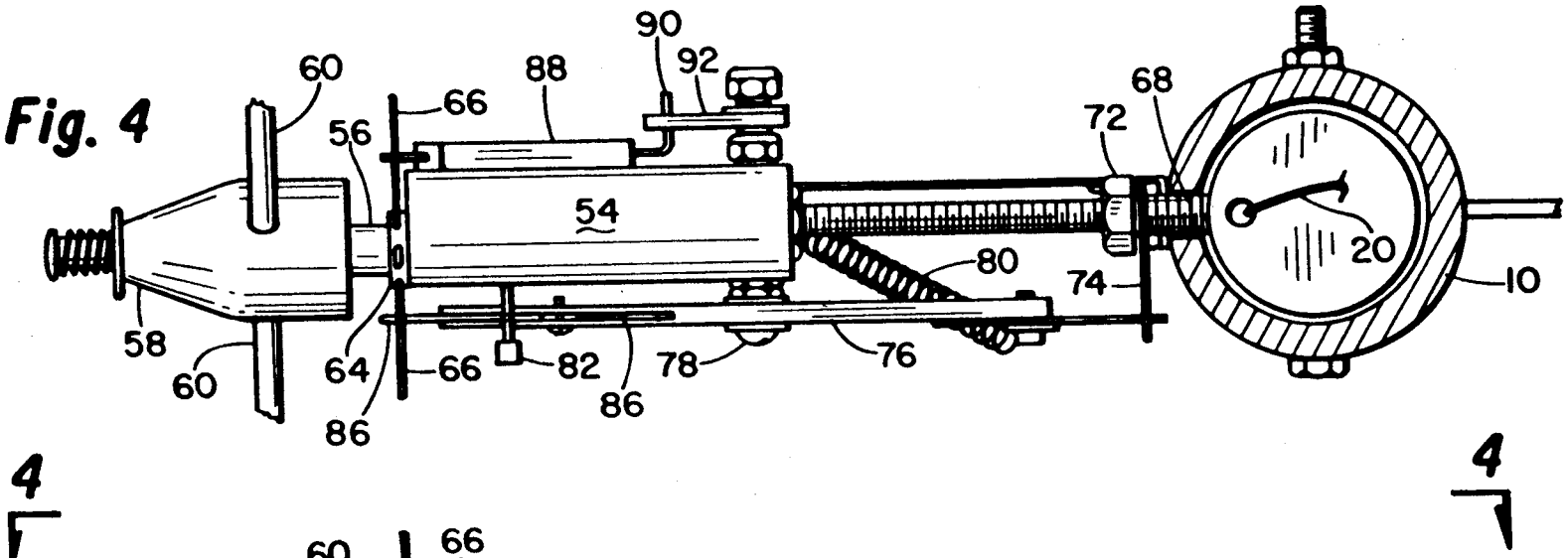
FIG. 4 is a plan view, partly in section, of the balloon mechanism shown in FIG. 4.
Figure 3:
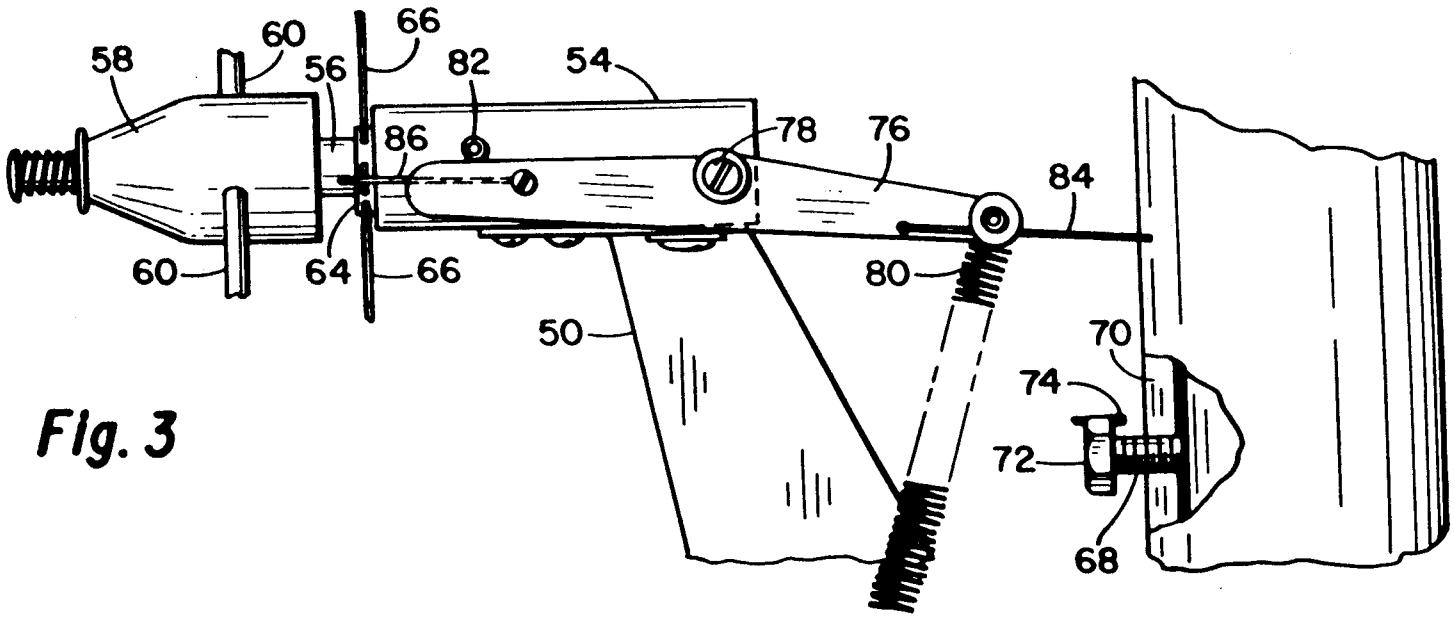
FIG. 3 is a left elevation of the balloon assembly shown in FIG. 2, on an enlarged scale.

Although the interval between the first and last contact with the wand 12 is an important (if not the most important) consideration in a given race, it may be desirable to provide a visual indication of the intermediate movements of the wand 12. For this purpose the present invention provides a rotating balloon assembly wherein the balloons are of preferably of different colors such that the indexing of the balloon mechanism will be readily visible from substantial distances. In this regard, FIGS. 2, 3 and 4 show a balloon mechanism comprising a vertical bracket 50 which is connected to the pipe 10 by suitable bolts 52. At the top of the vertical bracket 50 there is mounted a cylindrical housing 54 in which a rotatable shaft 56 is freely rotatably received. A hub 58 is mounted at the outer end of the shaft 56 and a plurality of arms 60 extend radially outward from the hub 58. As best shown in FIG. 2, a plurality of balloons 62 are mounted on the ends of these arms 60. A collar 64 is also mounted on the shaft 56 between the hub 58 and the housing 54. The collar 64 is provided with a plurality of wires or spokes 66 which are used for turning, or indexing, the shaft 56 in a manner described below.

The weight 20 is provided with a horizontal bolt or shank 68 which projects outwardly from the pipe 10 through a vertical slot 70. The bolt is provided with a head 72 which carries an L-shaped pin 74. The short end of the L is received in a horizontal hole on one side of the bolt head 72, whereas the long side of the L of the pin 74 is adapted to overlie the shank or bolt 68 as best shown in FIG. 4. An actuating arm 76 is mounted on one side of the housing 54 and is pivotally connected intermediate its ends to the housing by means of a bolt or shaft 78. A spring 80, which connects between one outer end of the arm 76 and the bracket 50, tends to urge the arms 76 in a clockwise direction (in relation to FIG. 3). However a stop 82, also mounted on the housing, prevents further clockwise movement of the arm 76 from the position shown in FIG. 3. The arm 76 is provided with a rearwardly extending pin 84 which is normally positioned above the end of the L-shaped pin 74. The other end of the arm 76 is provided with a forwardly projecting pin 86 which is positioned between the spokes 66 on the collar 64.

On the opposite side of the housing 54 from the actuating arm 76 is a mechanism for stopping the movement or indexing of the collar 64. This stop mechanism consists of a block 88 in which another L-shaped pin 90 is slidably received. A short inclined arm 92 is connected to the shaft 78 on the opposite side thereof from the arm 76. The arm 92 will rotate when the arm 76 rotates. Suitable nuts, locking nuts, washers, etc., will be mounted on the shaft 78 such that the shaft can freely rotate in the housing 54 while the arms 76 and 92 will rotate with the movement of the shaft 78. The lower end of the arm 92 is provided with a hole which receives the short arm of the L-shaped pin 90. The longitudinal arm of the L-shaped pin 90 extends through a suitable hole which extends along the length of the block 88 such that the outer end of the pin 90 is positioned between the spokes 76.

Assuming now that the wand 12 is being deflected by a kite string, the weight 20 will move upwardly and the pin 74 will contact the pin 84 on the arm 76 to turn the arm 76 in a counterclockwise direction, thereby causing the pin 86 to move downwardly to a position below one of the spokes 66. The arm 92 will pivot to withdraw the outer end of the pin 90 from between the spokes 66 so that the spoke assembly can rotate when the pin 86 contacts the spoke 66 immediately after the withdrawal of the pin 90. The movement of the weight 20 upwardly and downwardly will be extremely rapid. The spring 80 will quickly return the arm 76 to the position shown in FIG. 3 after the weight passes upwardly beyond the end of the pin 84. The upward movement of the left hand end of the arm 76 will cause the pin 86 to move one of the spokes 66 approximately 45 degrees. The stop pin 90 will immediately go back between the spokes 66. Assuming that there are eight spokes mounted on the collar 64, the indexing action described above will cause the collar 64 to move 45 degrees each time the pivotal wand moves the required gate clearance distance of approximately 30 degrees. This allows the pin 86 to move to a position under spoke 66. When the weight 20 drops downwardly to return to its lowermost position, the L-shaped pin 74 will contact the pin 84 on its downward movement, but will merely pivot out of the way by virtue of the fact that the short end of the pin 74 is pivotally mounted in the head 72 of the bolt 68.

For the purpose of moving the pipe 10 from place to place and securing it in a vertical position in the ground, a spade 94 is mounted at the lower end of the pipe 10. Simple foot pressure on the top of the space 94 will secure the pipe 10 in a desired location along the ground.

Figure 5:
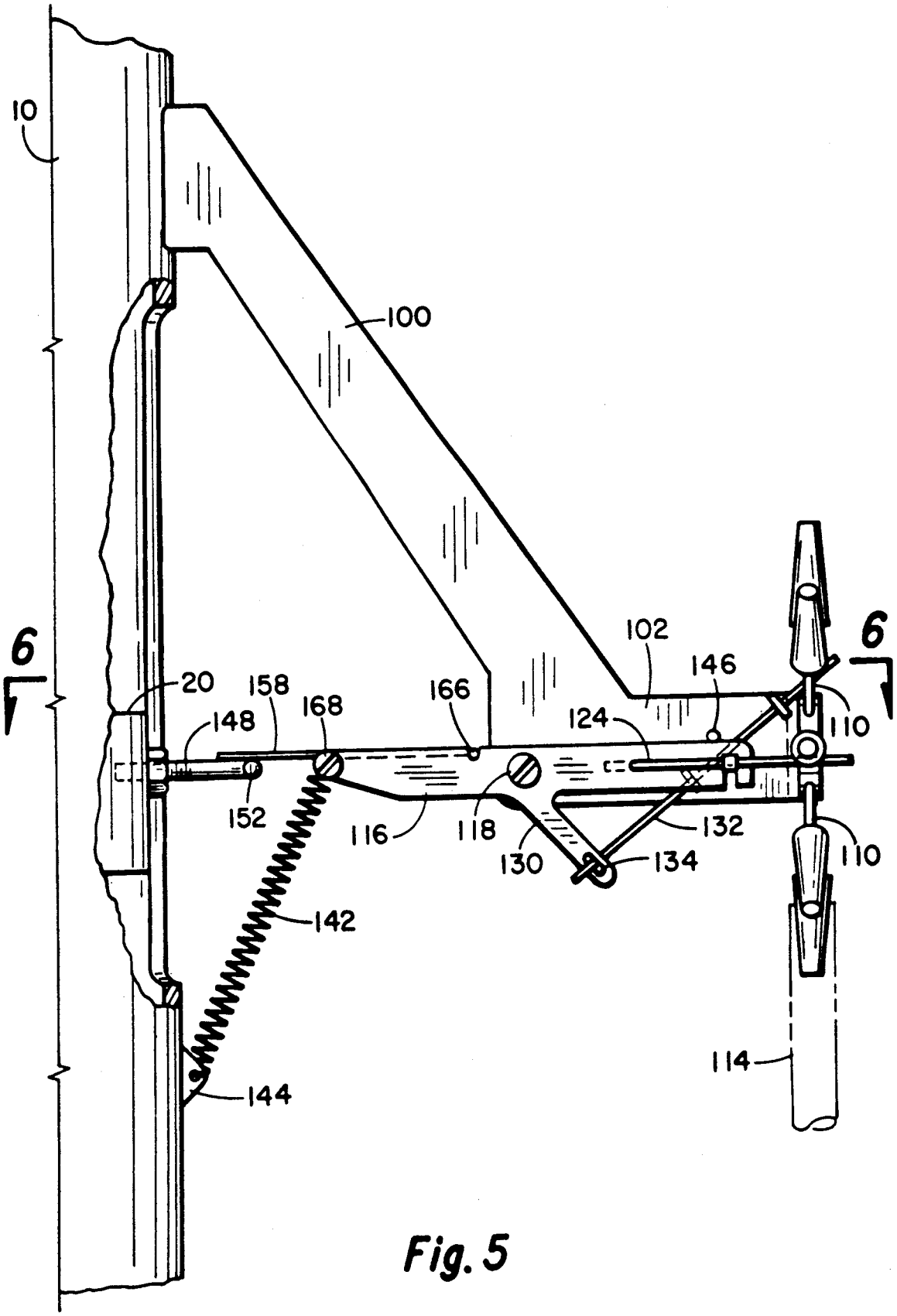
FIG. 5 is a left side elevation of a modified form of the balloon assembly.

FIGS. 5, 6 and 7 show a modified form of balloon mechanism which is similar in many respects in the embodiment described in FIGS. 2, 3 and 4. Referring now to FIGS. 5 and 6, the pipe 10 is provided with a bracket 100 which extends downwardly from the pipe 10. The upper end of the bracket 100 is attached to the pipe 10 in any convenient manner. The bracket 100 angles downwardly and forwardly from the pipe 10 and has a horizontal portion 102 at its lower end. The forward end of the horizontal section 102 is provided with an angled portion or plate 104 which is bent at right angles to the horizontal section 102. The plate 104 has a horizontal shaft 106 rotatably mounted thereon. The forward end of the shaft 106 connects with a hub 108 which carries a plurality of radial spokes 110. FIGS. 7 shows eight spokes 110, but obviously four could be provided, or more spokes could be provided if space permits. In any event, a balloon 112 is mounted on the outer end of each spoke 110 by means of a balloon connector or saddle 114. The rear portion of the horizontal member 102 provides a pivotal connection for an arm or lever 116, by means of a bolt 118, a spacer or bushing 120 and a nut 122. The forward end of the arm 116 is provided with a bent rod 124 which has its rear end received in a hole (not referenced) in the arm 116 and the extreme rear end 126 of the rod is bent flat against the side of the arms 126 opposite from the main portion. The center portion of the rod 124 is received in a bent tab 128 which will permit the rod 124 to be lifted upwardly out of the tab but which serves as a stop in the opposite direction. The other end of the rod 124 is interposed between the spokes 110.

Adjacent the center of the arm 116 is provided an angled extension 130 which extends downwardly and forwardly from the arm 116. A second bent rod 132 connects with the extension 130. The lower end of the bent rod 132 passes perpendicularly through a slotted opening 134 in the extension 130 and is bent over as at 136. The rod 132 has a straight section 138 which passes through a pair of tabs 140 such that its outer end projects into the space between the spokes 110. A spring 142, which connects between the rear end of the arm 116 and a tab 144 on the pipe 10 urges the arm 116 in a counterclockwise direction. However, a stop 146 located along the horizontal portion 102 prevents the arm 116 from moving any further counterclockwise from the positions shown in FIG. 5.

The weight 20 is provided with an angled member 148 having a threaded section 150 and another section 152 at right angles thereto. The threaded section 150 is received in a threaded hole (not shown) in the weight 20 and a lock nut 154 permits rotational adjustment of the angled member 148. The portion 152 extends behind the rear end of the arm 116. A third bent rod 156 is mounted on the rear end of the arm 116. The bent rod 156 is provided with a straight rear section 158 and a straight forward section 160 which is connected with the rear section by means of a central loop 162; the forward end of the straight section 160 connects with an angled section 164 which is received in a notch 166 along the upper edge of the arm 116. A bolt 168 passes through the rear end of the arm 116 and through the loop 162.

When the weight 20 is urged upwardly in the manner previously described, the portion 152 of the member 148 will lift against the rear portion 158 of the bent rod 156 so as to pivot the arm 116 in a clockwise direction (as it relates to FIG. 5). Movement of the arm 116 in a clockwise direction will permit the bent arm 124 to pivot and pass beneath one of the spokes 110, while at the same time the extension 130 will pull the rod 132 from between the spokes 110. After the weight 20 and associated member 148 pass beyond the end 158 of the rod 156, the spring 142 will return the arm 116 to the position shown in FIG. 5. During the return movement of the arm 116 to the position shown in FIG. 5, the rod 124 will have engaged one of the spokes 110 and moved the same one-eighth of a revolution. Simultaneously, the extension 130 will slide the rod 132 upwardly between adjacent spokes 110 to stop further movement of the hub 108. When the weight 20 drops downwardly, the member 148 will contact the end 158 of the bent rod 156; but the latter, through its loop 162, will freely pivot around the bolt 168 and permit the member 148 to pass beneath the bent rod 156.

Whereas FIGS. 2, 3 and 4, on the one hand, describe one type of balloon assembly, and FIGS. 5, 6 and 7, on the other hand, describe another type of balloon assembly, it should be understood that the term "balloon assembly" is used merely for illustrative purposes. Other objects, such as flags, cups, plates, etc., could be substituted in place of the balloons and, therefore, where the term "balloon assembly" is employed it should be understood that same would encompass other objects such as those mentioned above which would be mounted on the ends of the arms where the balloons are illustrated.

Figures 8, 9:
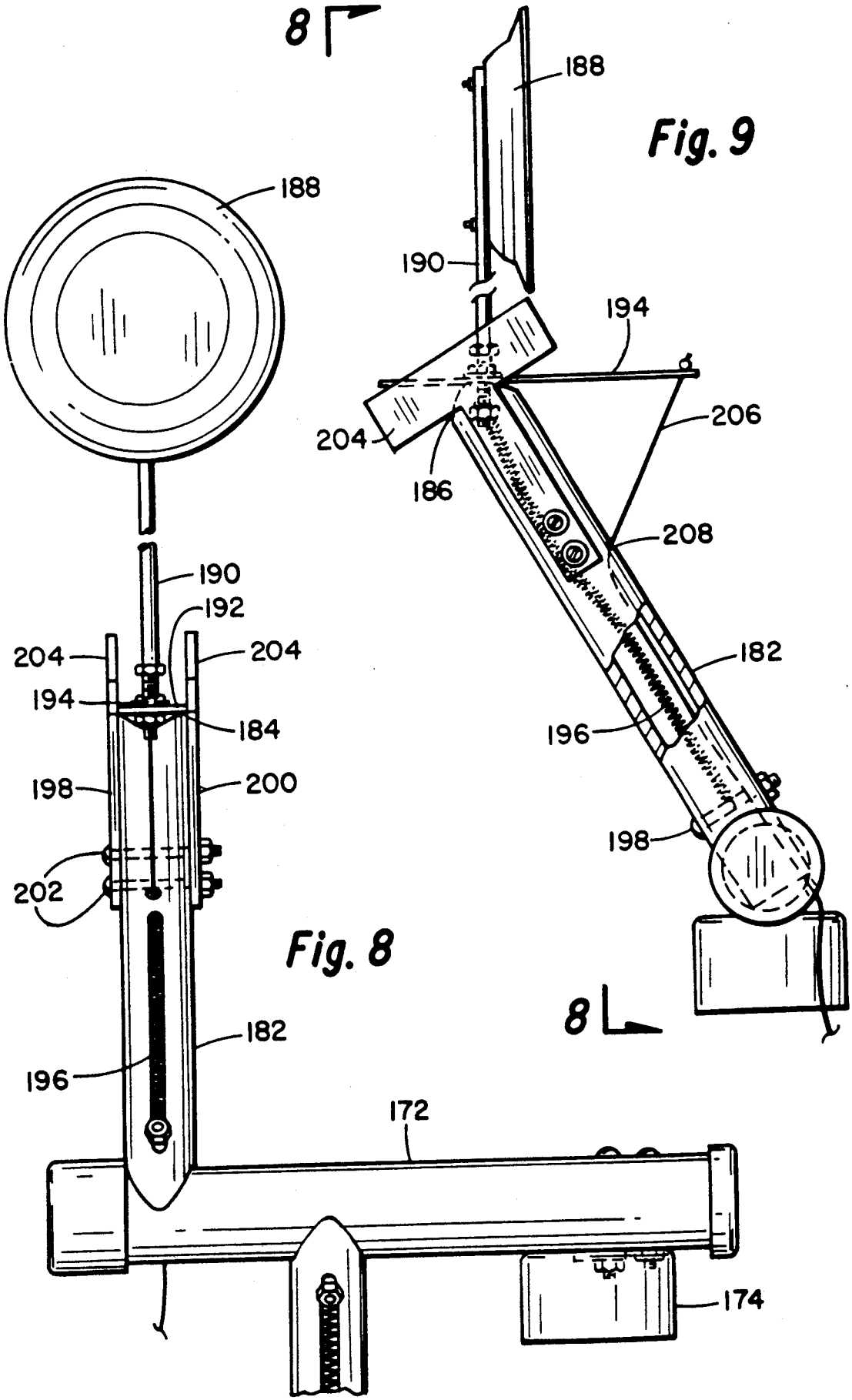
FIG. 8 is a front elevation of a simplified form of quick draw mechanism to be attached to the racing kite gate of FIGS. 1 and 2.
FIG. 9 is a left side elevation, partly in section, taken from FIG. 8.
Figure 10:
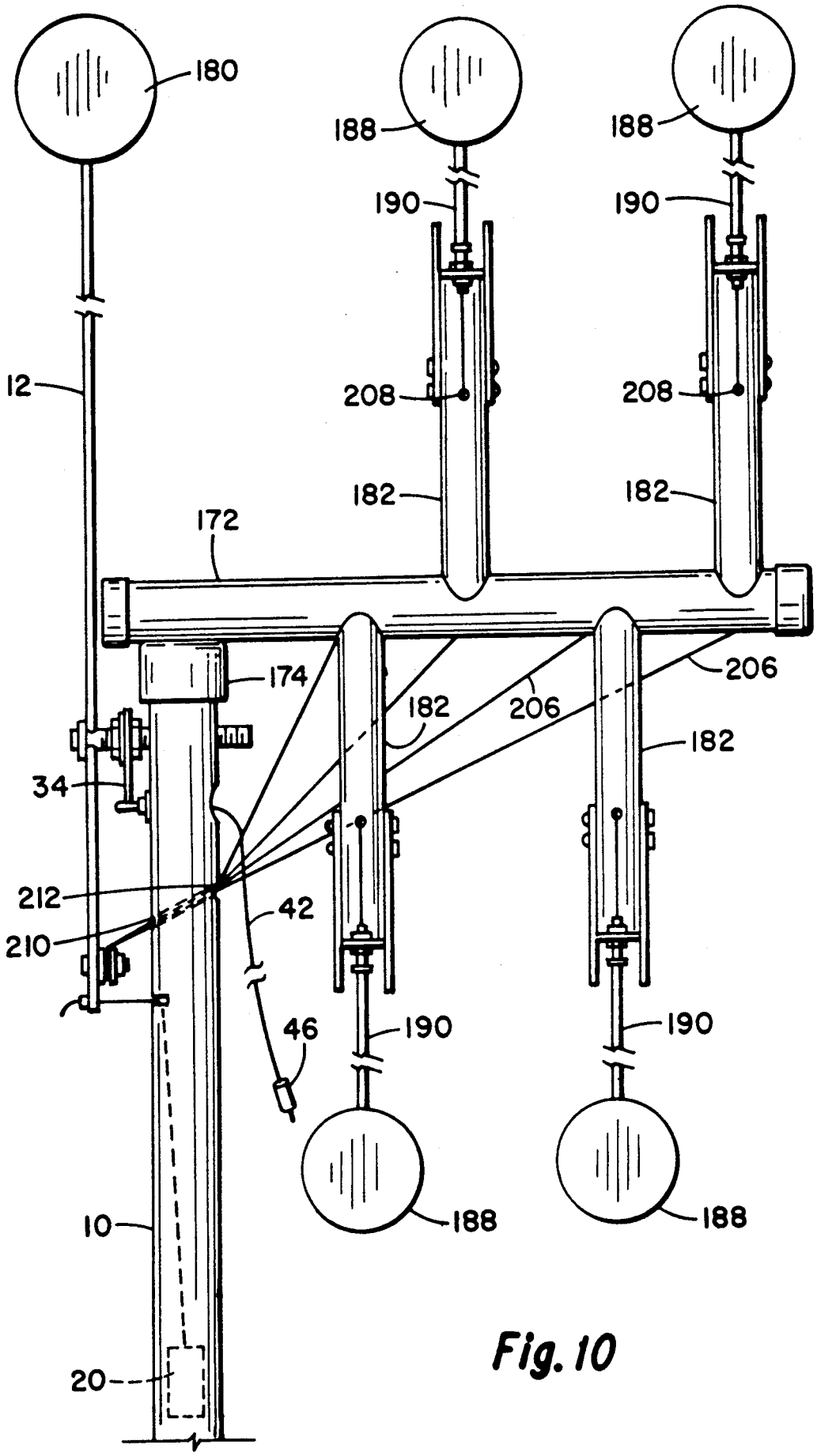
FIG. 10 is a front elevation of a preferred embodiment of quick draw mechanism shown attached to the top of the main pipe for the racing kite gate.

FIGS. 8, 9 and 10 show a "quick draw" target adapter for use in connection with the pipe 10. The target adapter comprises a horizontal arm or pipe 172 which is provided with a cup 174 along one of the lower ends thereof. The cup 174 is adapted to be received on the upper end of the pipe 10, as shown in FIG. 10.

With respect to the structure which is shown in FIGS. 1 and 2, the operator, or kite flyer, will be facing the apparatus from the right side of FIG. 2. However, when the quick draw modifications of FIGS. 8, 9 and 10 are employed, the position of the "quick draw" shooter will move 90 degrees and he will be facing the device looking from the right side of FIG. 1, so that he will see the structure as it appears in the plane of FIGS. 2 and 10. A target 180 in the form of a flat plate, or the like, will be mounted on the top of the wand 12. In the case of the quick draw device as shown in FIGS. 8 to 10, the wand 12 will not necessarily be provided with the same telescoping extensions, as would normally be the case were the device of FIGS. 1 and 2 used primarily as a gate for kite racing. The length of any extension used on the wand 12 will depend upon the type of projectile used by the "quick draw" shooter. In the case of a bullet or an arrow, a shorter extension would suffice; if one was using B-B shot or other light projectile, the extension would be longer. Furthermore, in case of an extremely light projectile, it may be desirable to lighten the weight 20.

The target 180 will be mounted on the wand 12 so that it is preferably five to eight feet above the ground. The target 180 will be the main target. That is, it will be the target that is used to initiate and terminate a sequence of shots which can be varied otherwise as desired. If the target 180 is hit with a bullet or dart (not shown), the wand 12 will move in a counterclockwise direction (in relation to FIG. 1) so that the timer (not shown) is actuated by the cam 134 in the manner previously described. When the target 180 is hit the next time, the cam 134 will send a signal to the timing mechanism to stop the latter.

Returning now to a consideration of FIGS. 8 and 9, a rearwardly and upwardly inclined pipe 182 is connected at its lower end to the horizontal pipe 172. The upper end of the pipe 182 is cut out so as to form a recess or groove 184 along the front and back of the pipe as it appears in FIG. 8. The edges of the pipe on the opposite sides of the groove 184 are rounded at 186 as shown in FIG. 9. An auxiliary target 188 (which will be essentially the same as the target 180) is mounted on a vertical rod 190. The lower end of the rod 190 connects with a horizontal member 192 which bears against and rides along the curvatures 186 on the opposite sides of the upper end of the pipe 182.

A horizontal rod 194 is attached to the lower end of the rod 190 and is moveable therewith. The lowermost end of the rod 190 connects with a spring 196 which extends downwardly through the pipe 182 and is anchored at its lower end to a bolt 198. The spring exerts a downward force on the rod 190 and tends to hold the target 188 in the position shown in FIG. 9. However, if a bullet or dart should hit the target 188 in a direction from the right of FIG. 9, the target assembly consisting of the target 188, the rod 190, cross member 192 and the horizontal rod 194 will be tilted rearwardly and the member 192 will ride over the top of the curvature 186 so that it comes to an over-the-center position to the left of that shown in FIG. 9. The solid line position shown in FIG. 9 represents a first over-the-center position for the target 188, and the spring 196 will maintain the target in this position until it is struck by a bullet or dart, as indicated above. When the target 188 is hit by a bullet or dart, it moves to the left to the second over-the-center position where it is maintained by the spring 196 until the reset operation occurs, as will be explained below.

Whereas FIGS. 8 and 9 show a single target for the principal purpose of explaining the details of the target 188 and its operation, FIG. 10 represents one of the preferred embodiments wherein a plurality of targets 188 are employed. In the embodiment shown in FIG. 10, there are two targets 188 which are mounted on pipes 182 extending upwardly and rearwardly in the same manner shown in FIGS. 8 and 9; two additional targets extend below the pipe 172 by means of pipes 182 which extend downwardly and rearwardly away from the pipe 172. In order to keep the cross member 192 "on track" as it rides over the curved surfaces 186, a pair of T-shaped members 198 and 200 are secured to opposite sides of the pipe 182 by means of bolts 202. The horizontal portions 204 of the T's 198 and 200 abut against the sides of the cross member 192 so that the latter will always ride over the curved surfaces 186.

For reset purposes, each rod 194 has a string 206 attached to its outer forward end. Each string 206 passes through a hole 208 in its associated pipe 182. From the lower end of each pipe 182, each string 206 passes through a pair of openings 210 and 212 in the pipe 10 so that the extreme ends of the strings 206 can be attached to the lower end of the wand 12.

One possible sequence of operation of the targets 180 and 188 will now be described. The shooter (not shown) will first hit the target 180 to deflect the wand 12 rearwardly and initiate the timer. Thereafter, he will hit the four intermediate targets 188 in any preferred sequence such that all of the targets 188 are now in the rearward or tripped condition. After successfully tripping all of the intermediate targets 188, the shooter will then hit the target 180 for the second time. When the target 180 is hit for the second time, the wand 12 will move as before to shut off the timer and, at the same time, the strings 206 will be pulled to reset the targets 188 to the positions shown in FIG. 9.

Figure 11:
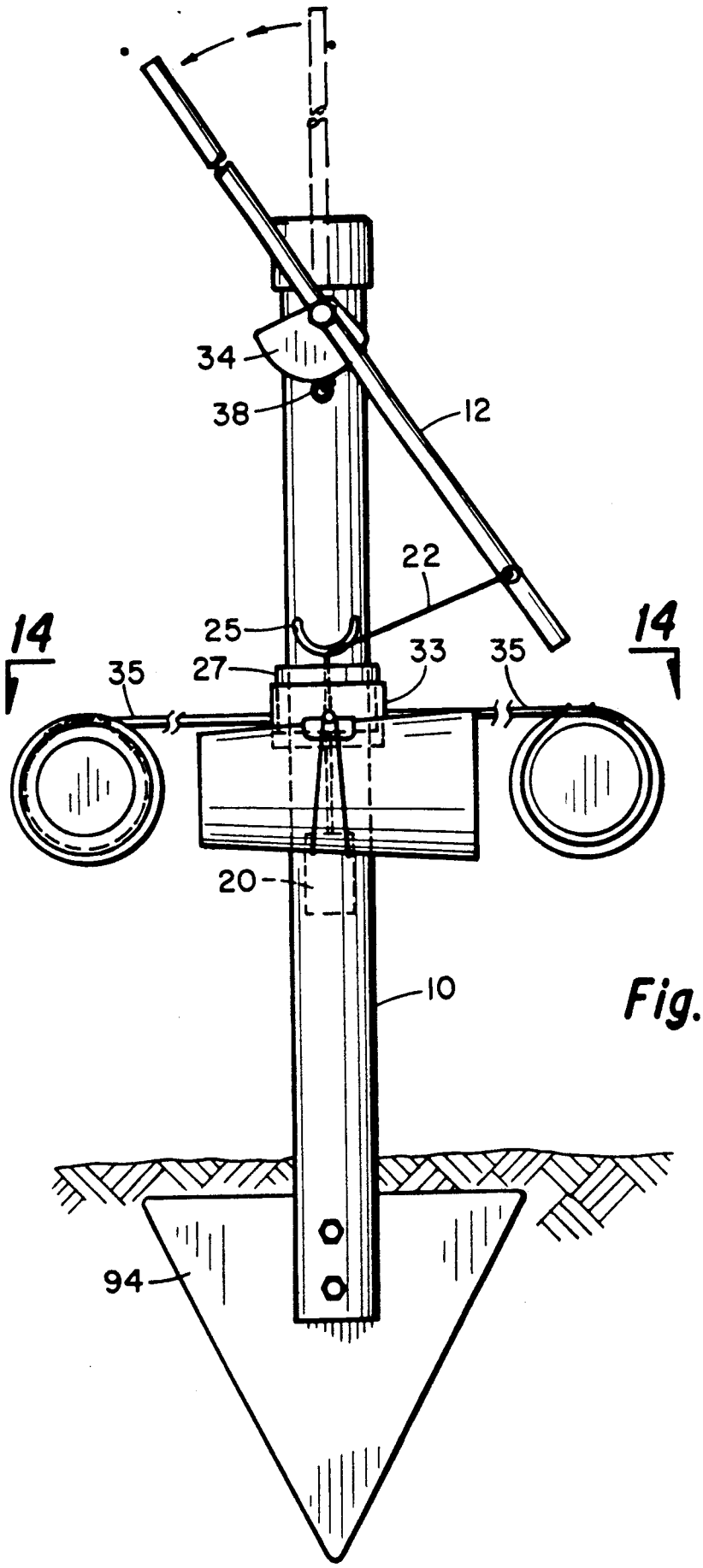
FIG. 11 is a front elevation of a modified form of racing kite gate employing a different type of visual aid.
Figure 12:
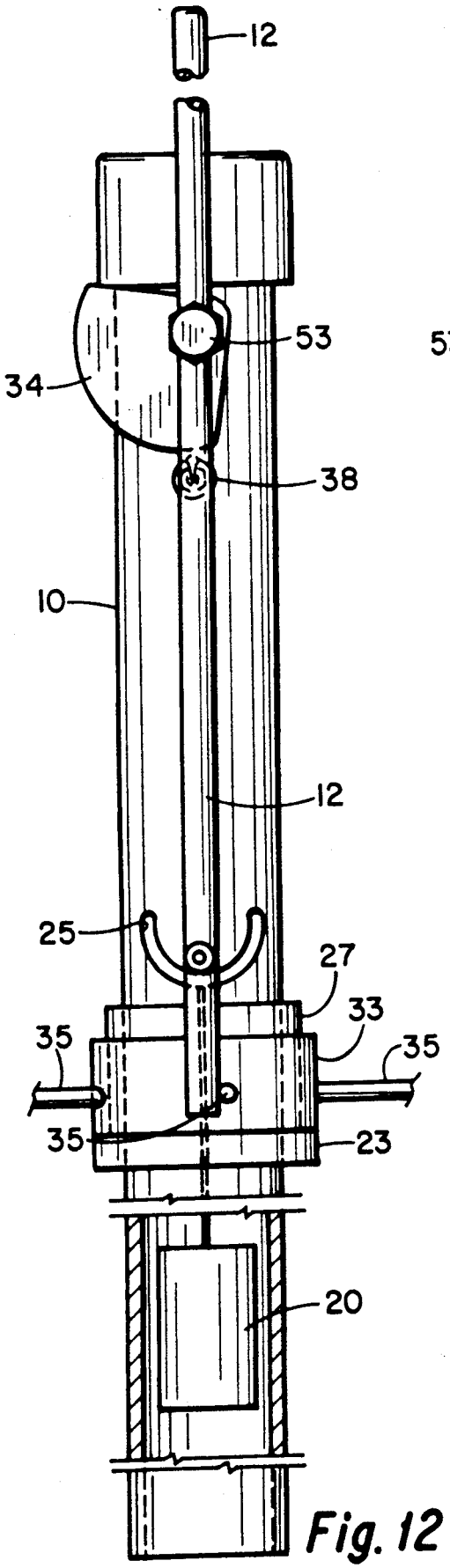
FIG. 12 is an enlarged front elevation of the upper portion of the device as shown in FIG. 11.
Figure 13:
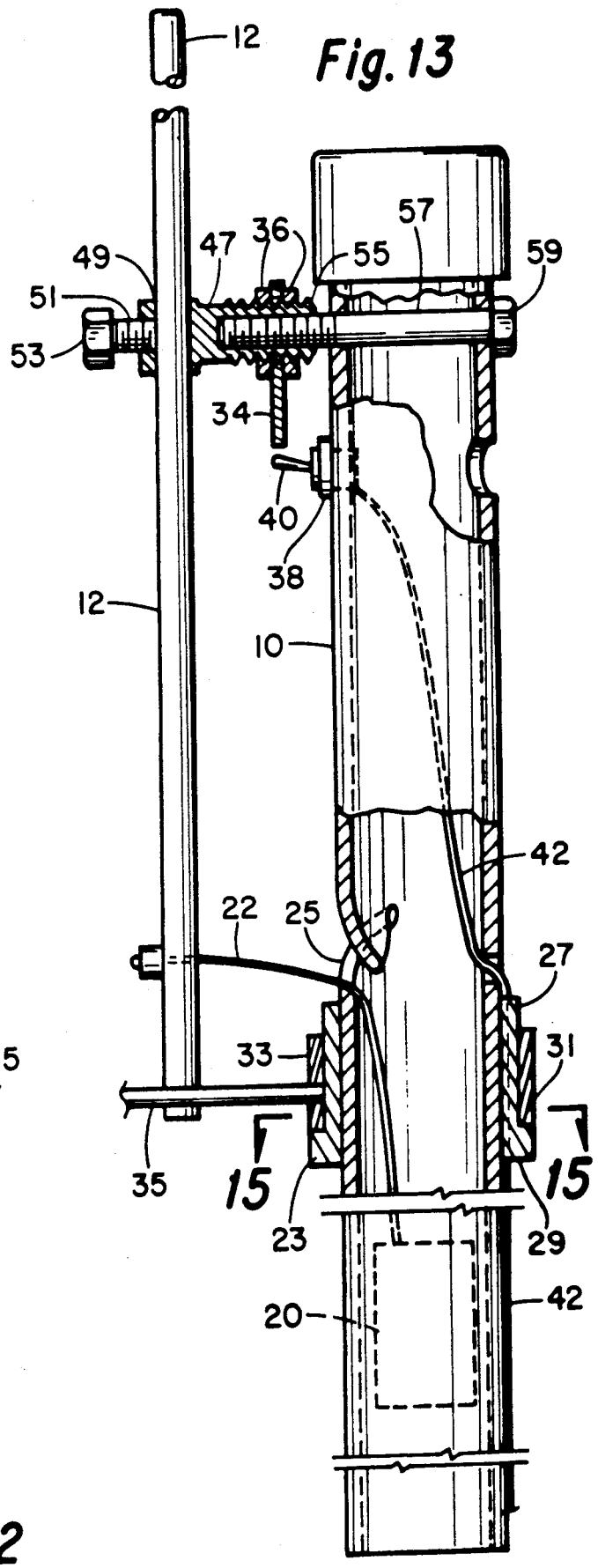
FIG. 13 is a right side elevation taken from FIG. 12.

Referring now to FIGS. 11 through 15, these figures disclose a modification of the racing gate kite wherein a different type of visual mechanism is employed as an alternate to the balloon mechanism shown in FIGS. 2 through 7. In FIGS. 11 to 13, the pipe 10 is substantially identical to the pipe 10 shown in FIGS. 1 and 2. However, the slot 26 in FIGS. 1 and 2, which is shown in those figures as being extended horizontally, is replaced by a curved slot 25. The cord or cable 22 from the lower end of the wand 12 extends down through the pipe 10 to the weight 20 such that the action of the weight 20 on the wand 12 is the same as that previously described in relation to FIGS. 1 and 2. FIGS. 12 and 13 show a collar or sleeve 23 having an upper portion 27 of smaller diameter and a lower flange 29 of larger diameter and forming a shoulder 31 where the upper portion 27 terminates. A hub 22 is rotatably received on the reduced portion 27 of the collar 23 and, a plurality of spokes 35 extend radially outward from the hub. The lower end of the wand 12 extends downwardly to a position slightly below the spokes 35 when the wand is in a vertical position.

Figure 14:
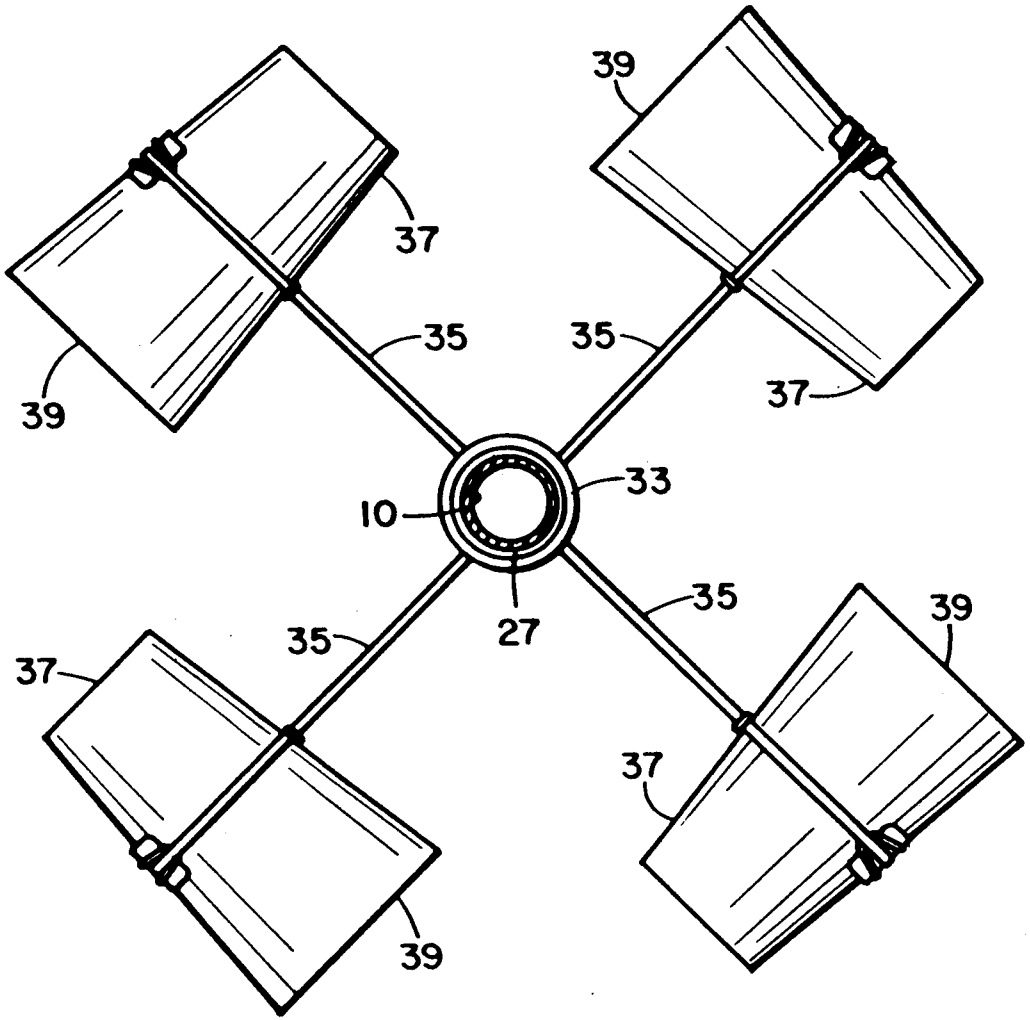
FIG. 14 is a horizontal cross sectional view, on a reduced scale, taken along section line 14—14 of FIG. 11.

Turning now to FIG. 14, a plurality of cups 37 are mounted on the ends of the arms or spokes 35 with their open ends 39 facing in a counterclockwise orientation. If a wind were present, it would tend to rotate the hub 33, spokes 35 and cups 37 in a clockwise direction. However, with the wand 12 in the vertical position shown in FIG. 12, the assembly would be unable to move because the lower end of the wand would serve as a stop. However, if the wand were actuated by a kite string moving, for example, in a left-to-right direction, the lower end of the wand 12 would spring out of the way and allow the cup assembly to rotate. When the wand returns to the vertical position shown in FIG. 12, it would then be positioned between a different pair of spokes 35. Movement of the cup assembly can be perceived by the naked eye at a distance, particularly, if the cups are made of different colors.

Figure 15:
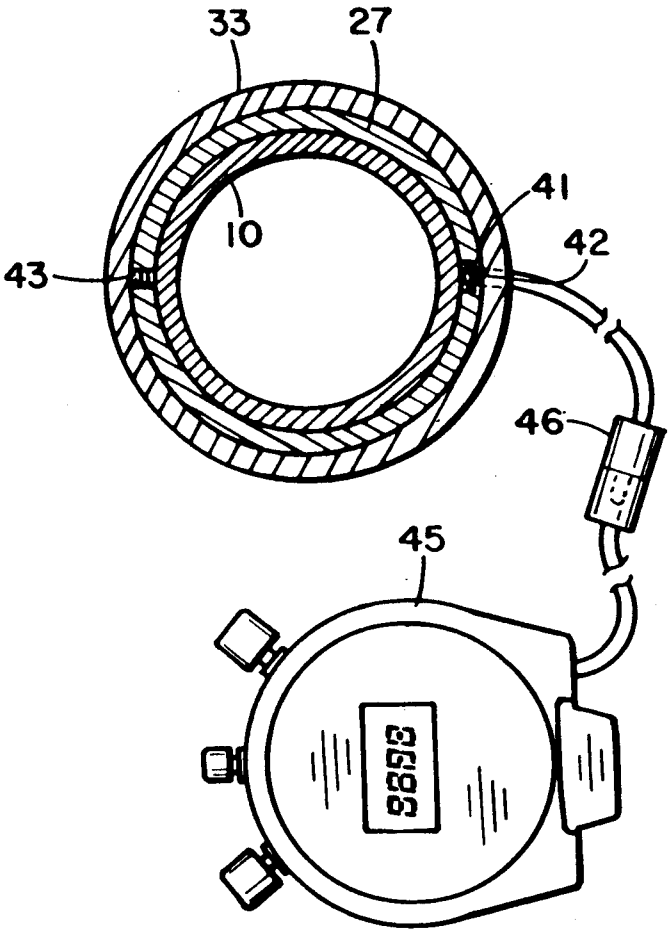
FIG. 15 is a cross sectional view, on a slightly enlarged scale, taken along section 15—15 of FIG. 13.

With respect to the electrical cord 41 which connects from the microswitch to the timer, the sleeve 23 is provided with a slot 41 such that the electrical cord 42 can pass downwardly along the outside of the pipe 10 between the pipe and the sleeve 23. FIG. 15 shows the slot 41 in the upper reduced portion of the collar 23 and the electrical cord 42 positioned in the slot 41 between the upper portion 27 of the collar 23 and the pipe 10. A set screw 43 can be used to secure the collar 23 to the pipe 10. The electrical cord 42 will pass from the bottom of the collar 23 along the outside of the pipe 10 to the connector 46 and thence to a timing device 45. The details of the timing device are considered to be conventional and form no part of the present invention. Suffice to say that the timing device 45 is an electrical type of stopwatch which can be started and stopped in response to signals from the electrical cord 42.

FIGS. 12 and 13 show a slightly different arrangement for the pivoted attaching of the wand 12 to the upper end of the pipe 10. A threaded shaft 47 has the cam 34 and lock nuts 36 mounted thereon. The threaded member 47 is provided with a vertical hole 49 through which the rod 12 passes. A set screw 51 having a head 53 will lock the wand 12 in the hole 49. The threaded shaft 47 has an internal threaded opening 55 in which a threaded bolt 57 is received. The threaded bolt 57 passes through aligned holes in the upper end of the pipe 10 and is provided with a head 59. The end of the bolt 57 opposite from the head 59 is threaded as shown and is received in the hole 55 as indicated above.

Whereas the present invention has been described in particular relation to the drawings attached hereto, it should be understood that the other and further modifications, apart from those shown or suggested herein, may be made within the spirit and scope of this invention.

What is claimed is:

1. A racing gate for kites comprising a vertical pipe having an upper end and a lower end, the lower end supporting the pipe from the ground, an elongated wand having an upper end and a lower end, means for pivotally attaching the wand above its lower end to the pipe adjacent its upper end, a weight slidably mounted within said pipe, and a cord connected from the lower end of said wand to said weight for maintaining said wand in a normally vertical condition.

2. A racing gate according to claim 1 wherein the lower end of the pipe is provided with means for impaling the pipe into the ground.

3. A racing gate according to claim 1 wherein a rotating balloon assembly is attached to the pipe, said rotating balloon assembly comprising a bracket connected to the pipe, a horizontal shaft freely rotatably mounted on the bracket, a hub mounted on one end of the shaft, a plurality of arms extending radially outward from the hub and carrying a plurality of balloons on the outer ends of the arms, and means responsive to the up and down movement of the weight for partially rotating said hub each time that the weight moves up and down.

4. A racing gate according to claim 1 wherein a rotating balloon assembly is attached to the pipe, said rotating balloon assembly comprising a bracket connected to the pipe, a cylindrical housing mounted on the bracket, a horizontal shaft freely rotatably received within the cylindrical housing, a hub mounted on one end of the shaft, a plurality of arms extending radially outward from the hub and carrying a plurality of balloons on the outer ends of the arms, a collar fixed to the horizontal shaft and rotatable therewith, a plurality of spokes extending radially outward from the collar and means responsive to the up and down movement of the weight for engaging the spokes on the collar to partially rotate the hub.

5. A racing gate according to claim 1 wherein the wand is pivotally attached to the pipe by means of a horizontal bolt which rotates with the pivotal movement of the wand, a cam mounted on the horizontal bolt for rotation therewith, an electrical switch mounted on the pipe in a position adjacent the cam, the cam having an outer edge which is shaped in the form of a curve which is eccentric with respect to the center line of the horizontal bolt so that the edge of the cam is out of contact with the electrical switch when the wand is in its normal upright position, the curvature of the outer edge of the cam being such that the edge of the cam will contact the electrical switch when the wand is pivoted a predetermined amount in a given rotary direction of the wand, a timer connected to the electrical switch whereby when the wand pivots the predetermined amount in the given rotary direction the electrical switch will be actuated to start the timer and whereby when the wand again pivots the predetermined amount in the given rotary direction the electrical switch will be actuated to stop the timer.

6. A racing gate according to claim 5 including a quick draw attachment comprising a cup adapted to be received over the upper end of the vertical pipe, a horizontal pipe connected to the cup and extending away from the vertical pipe, a target plate attached to the wand above and substantially parallel to the horizontal bolt, a plurality of individual targets connected at right angles to the horizontal pipe in spaced relation therealong, each individual target comprising a tube having an inner end connected to the horizontal pipe and an outer end spaced away from the horizontal pipe, the outer end of each tube being provided with a recess extending from the front to the back of the tube such that the edges of the tube on the opposite sides of the recess are convexly curved, a horizontal member mounted to bear against the curved edges of each tube, a vertical rod extending upwardly from each horizontal member, a target plate mounted at the upper end of each vertical rod in parallel relation with the first mentioned target plate, a spring connected to the lower end of each vertical rod and extending downwardly into its associated tube to hold the vertical rod in a substantially vertical position, a horizontal rod attached to the lower end of each vertical rod and moveable therewith, each horizontal rod having an outer forward end, a string connected between the outer end of each horizontal rod and the lower end of the wand whereby when the target plate on the wand is hit by a projectile, the wand will be deflected to start the timer and whereby when each target plate on the individual targets is hit by a projectile, the associated vertical rod will move rearwardly while the horizontal member moves to an over the center position and whereby, when a projectile strikes the target plate on the wand a second time, the lower end of the wand will pull on the strings to reset the individual targets to their original positions.

7. A racing gate as set forth in claim 1 including a sleeve mounted on the vertical pipe, a collar rotatably mounted on the sleeve, a plurality of horizontal spokes extending outwardly from the collar, the spokes being positioned so as to intercept the lower end of the wand when the wand is in a vertical position, a wind responsive device mounted on the outer end of each horizontal spoke whereby when the wand is deflected from the vertical position, the collar will be free to rotate and whereby when the wand returns to its vertical position, one of the spokes will come to rest against the lower end of the wand.

* * * * *